US006841040B2

(12) United States Patent
Lepomäki et al.

(10) Patent No.: US 6,841,040 B2
(45) Date of Patent: Jan. 11, 2005

(54) METHOD AND DEVICE FOR FEEDING CHEMICALS INTO A FIBRE SUSPENSION

(75) Inventors: Hannu Lepomäki, Laukaa (FI); Juhani Sams, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 137 days.

(21) Appl. No.: 10/314,658

(22) Filed: Dec. 9, 2002

(65) Prior Publication Data

US 2003/0106661 A1 Jun. 12, 2003

(30) Foreign Application Priority Data

Dec. 12, 2001 (FI) ..... 20012447

(51) Int. Cl.[7] ..... D21F 1/00

(52) U.S. Cl. ..... 162/183; 162/264; 162/322; 162/336; 162/343

(58) Field of Search ..... 162/183, 264, 162/251, 322, 343, 336; 209/192, 255, 268, 490; 366/233, 184, 341

(56) References Cited

U.S. PATENT DOCUMENTS

| | | | | |
|---|---|---|---|---|
| 5,183,537 A | | 2/1993 | Hergert et al. | |
| 5,196,091 A | | 3/1993 | Hergert | |
| 5,560,807 A | | 10/1996 | Hauser | |
| 5,942,087 A | * | 8/1999 | Pruszynski | 162/175 |
| 6,210,535 B1 | * | 4/2001 | Huovila et al. | 162/322 |
| 6,270,624 B1 | * | 8/2001 | Huovila et al. | 162/127 |
| 6,347,883 B1 | | 2/2002 | Ekholm | |
| 6,368,460 B1 | * | 4/2002 | Aidun | 162/216 |
| 6,562,196 B1 | * | 5/2003 | Huovila et al. | 162/198 |
| 6,712,931 B1 | * | 3/2004 | Gron et al. | 162/128 |
| 6,719,881 B1 | * | 4/2004 | Hunter et al. | 162/164.1 |
| 6,723,204 B2 | * | 4/2004 | Van Handel et al. | 162/183 |

FOREIGN PATENT DOCUMENTS

| | | |
|---|---|---|
| GB | 2 255 729 A | 11/1992 |
| SE | 512 192 | 2/2000 |
| SE | 522 494 | 2/2004 |
| WO | WO 00/44486 | 8/2000 |

OTHER PUBLICATIONS

Notice of Opposition issued May 3, 2004, in Finnish Patent No. 111397 (App. No. 20012447).

Search Report issued in Finnish Patent 20012447.

* cited by examiner

*Primary Examiner*—Peter Chin
(74) *Attorney, Agent, or Firm*—Stiennon & Stiennon

(57) ABSTRACT

In the short circulation of a paper machine, a chemicals flow ($F_1$) is fed into a fibre suspension flow in connection with a pipe expansion comprising a first pipe (1) and a second pipe (2) having a larger diameter than the first pipe, which pipes are connected to each other by means of an expansion step (3) perpendicular to the direction of flow. The chemicals flow ($F_1$) can be passed so as to be mixed with the fibre suspension flow either in the second pipe (2) in an ideal mixing zone situated after the expansion step (3) or in the first pipe (1) so close to the expansion step (3) that the chemicals which are added have no time to react with the fibre suspension before the flow enters the expansion step (3).

22 Claims, 3 Drawing Sheets

METHOD AND DEVICE FOR FEEDING CHEMICALS INTO A FIBRE SUSPENSION

CROSS REFERENCES TO RELATED APPLICATIONS

This application claims priority on Finnish Application No. 20012447, filed Dec. 12, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for feeding chemicals into a fibre suspension in the short circulation of a paper machine. The invention also relates to a device for feeding chemicals into a fibre suspension in the short circulation of a paper machine.

Paper or board is a mixture comprising fibres, fines and different additives. Some of the paper components are mixed together already in the stock preparation department, but some of the chemicals are added to a finished stock mixture only in the short circulation a little before the stock is fed to a headbox.

From the standpoint of the properties of paper or board, it is very important that all raw material components are mixed so that they form a mixture that is as homogenous as possible when a web is formed. This requires an efficient system for feeding chemicals in the short circulation of the paper machine. It is particularly important that the chemicals are well mixed in the entire stock volume. For example, retention agents used for improving the retention of fines in a wire section must be mixed into the pulp as uniformly as possible to achieve maximal efficiency and to avoid variation in the properties of paper. Retention agents are usually fed before devices that generate shear stresses in the flow, such as a pump, a screen, or hydrocyclones. The chemicals are often fed into a pipe by means of a feed ring. A problem lies in causing the chemicals to be mixed uniformly in plug flow. It is also possible to use slot nozzles fitted crosswise inside a pipe. The problems with this arrangement include a high risk of contamination, and poor miscibility.

In general, it can be stated that a homogeneous mixture is produced most easily when the mixing volume is small and the turbulence enhancing mixing is sufficiently strong. In paper and board manufacturing processes, attempts have been made to make use of devices generating turbulence in the flow by dosing chemical components before a screen or a pump. When the rotor blades of a screen or a pump rotate quickly, very strong shear fields are created which generate turbulence. In practice, the thus generated shear fields may be even too strong, causing the break up of polymer chains, the activity of polymers as retention aids being thus weakened.

An object of the invention is to cause chemicals to be uniformly distributed in a fibre suspension, thus resulting in a homogeneous mixture. One further object of the invention is to carry out the feeding of chemicals so gently that polymer chains do not break up.

SUMMARY OF THE INVENTION

Fibre suspension typically has a tendency to flocculate, which substantially hampers the optimal mixing of chemicals. The floc structure can be broken by producing sufficient turbulence in the flow. One advantageous way to fluidize fibre suspension is to produce turbulence in it in a step-shaped expansion part of a flow duct. This type of arrangement is used, for example, in a turbulence generator of a headbox. A sudden expansion of a flow pipe generates in the flow a reverse vortex, at the boundary surfaces of which there is a strong shear field which creates considerable turbulence. The reverse vortex extends to a stagnation point, after which the generation of turbulence gradually diminishes. Strong turbulence breaks up flocs in fibre suspension and leads to the fluidization of the flow. In order that fluidization should be as efficient as possible, it shall be ensured that there is enough space for the formation of a reverse vortex in all process conditions.

In the method according to the invention, the fibre suspension flow is fluidized by passing it to a rotationally symmetrical pipe expansion, in which a first pipe expands stepwise into a second pipe, and a chemicals flow is fed into the fibre suspension in connection with the pipe expansion. A chemicals flow can be fed into the second pipe in an ideal mixing area situated after the expansion step or into the first pipe so close to the expansion step that the chemicals have no time to react before they enter the reverse vortex generated by the expansion step in the flow. Feeding takes place through injection holes or injection tubes situated in the expansion step or on the circumference of the pipe, said holes or tubes being placed symmetrically on different sides of the pipe. There may also be several feed points one after the other.

The force of the shear field produced in the rotationally symmetrical flow duct expansion is sufficiently great to provide optimal conditions for the mixing of chemicals but the shear stresses are considerably gentler than, for example, in a shear field created by a pump or screen blades. In other words, the optimal way to mix chemicals into the entire fibre suspension volume is to dose the different components into the pipe expansion such that they are guided to the boundary surface of a reverse vortex formed after the expansion and, thus, to a shear field that is sufficiently strong yet still preserves the molecule chain of polymers unbroken. The dosing of chemicals can be accomplished either at one or more successive points of the pipe expansion.

The arrangement in accordance with the invention makes it possible to reduce the feed quantities of chemicals because of a more uniform distribution of chemicals, thus achieving cost savings.

BRIEF DESCRIPTION OF THE DRAWINGS

In the following, the invention will be described with reference to the figures of the appended drawings, but the invention is not meant to be strictly limited to the details of them.

DESCRIPTION OF THE PREFERRED EMBODIMENTS

Figure 1A:
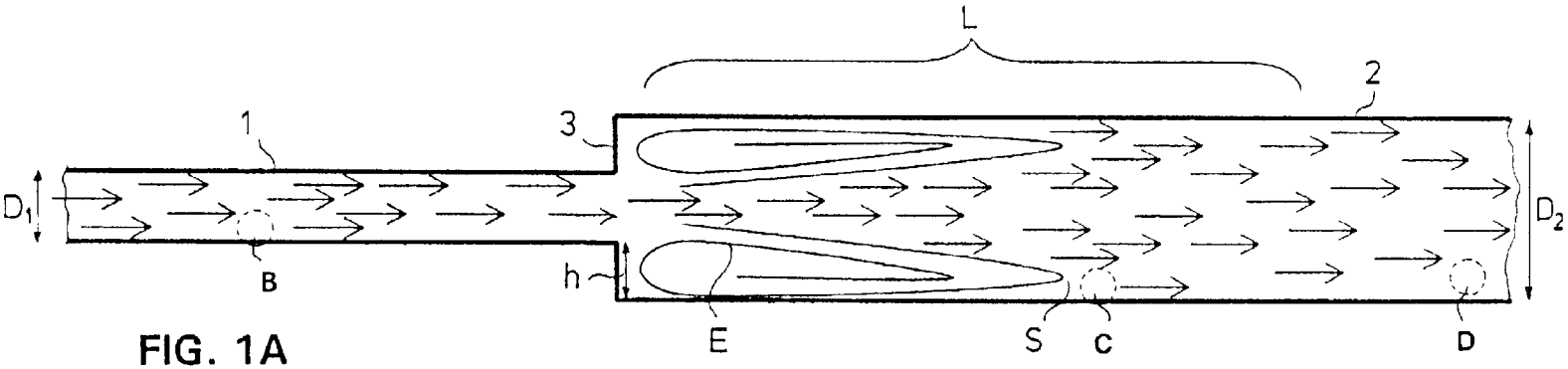
FIG. 1A is a schematic view of the effect of a pipe expansion on the behaviour of flow.

With reference to FIGS. 1A–1D, the effect of a stepwise expansion of the cross-sectional area of a flow duct on a fibre suspension flow is examined first. The fibre suspension flows in the direction indicated by arrows in a first pipe 1 and, after an expansion step 3, the flow continues in a second pipe 2, which is coaxial with the first pipe 1. The expansion step 3 is a ring flange which is perpendicular to the axial direction of the pipes 1 and 2 and the inside diameter of which corresponds to the diameter $D_1$ of the first pipe 1 and the outside diameter of which corresponds to the diameter $D_2$ of the second pipe 2. The ratio of the diameter $D_1$ of the pipe portion preceding the expansion step 3 to the diameter $D_2$ of the pipe portion situated after it is advantageously $D_2/D_1$=1.1 to 5.0. In the arrangement in accordance with the invention, the height h of the expansion step 3=$(D_2-D_1)/2$ is advantageously at least 50 mm when the diameter of the pipe is 500 mm. The height h of the expansion step 3 must be in any case greater than fibre length, i.e. at least 2 mm.

The expansion of the cross-sectional flow area produces a reverse vortex E in the flow, and there are high shear stresses in the boundary layers of said reverse vortex. They generate turbulence in the flow, which turbulence is strong enough to break up flocs, thereby causing the flow to be fluidized. When the fibre suspension flow is fluidized, its flow characteristics change so that they are similar to the flow characteristics of water, which means that multiphase flow begins to behave like single-phase flow.

Figure 1D:
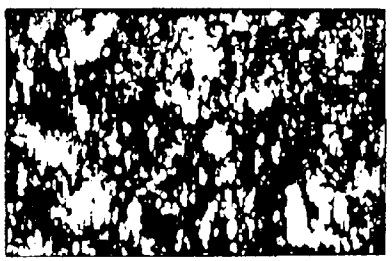
FIG. 1D illustrates the degree of flocculation in a fibre suspension at point D in FIG. 1A.
Figure 1C:
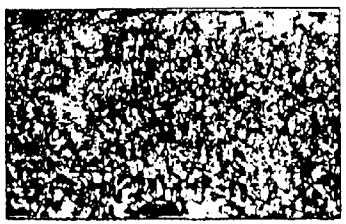
FIG. 1C illustrates the degree of flocculation in a fibre suspension at point C in FIG. 1A.
Figure 1B:
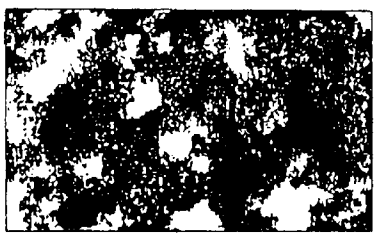
FIG. 1B illustrates the degree of flocculation in a fibre suspension at point B in FIG. 1A.

FIGS. 1B–1D illustrate the degree of flocculation in the fibre suspension before the expansion step 3 at point B, immediately after the end point of the reverse vortex E i.e. after a stagnation point S at point C, and after a short reflocculation period at point D. Before the expansion step 3, floes are large (FIG. 1B) and the flow moves forward as plug flow. After the stagnation point S of the reverse vortex E, the size of floes is small and they are distributed evenly (FIG. 1C). Turbulence keeps the flow efficiently mixed. The greater the distance from the expansion step 3, the more strongly visible is the reflocculation of floes (FIG. 1D).

The expansion step 3 is thus followed by an area of a turbulent and highly fluidized flow, which extends in the flow direction some distance past the stagnation point S and which is called an ideal mixing zone. The length L of this ideal mixing zone depends, among other things, on the height h of the expansion step 3, on the consistency of the fibre suspension and on the average length of fibres. The length L of the ideal mixing zone is generally of the order of 20–50 times the height h of the expansion step. As shown in FIG. 1A, the height h is measured as the distance between the wall of the first pipe 1 to the radially outward wall of the second pipe 2.

Figure 2:
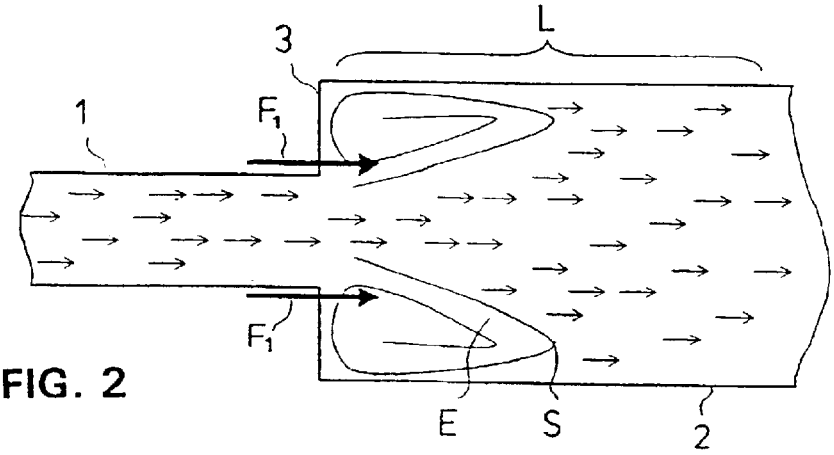
FIG. 2 shows the feeding of chemicals into a pipe expansion through an expansion step.
Figure 3:
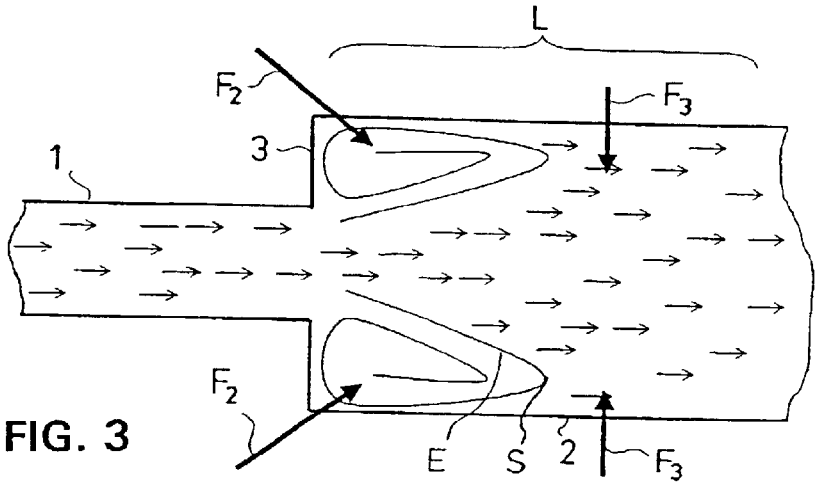
FIG. 3 shows two alternative chemicals dosing positions in connection with a pipe expansion.
Figure 4:
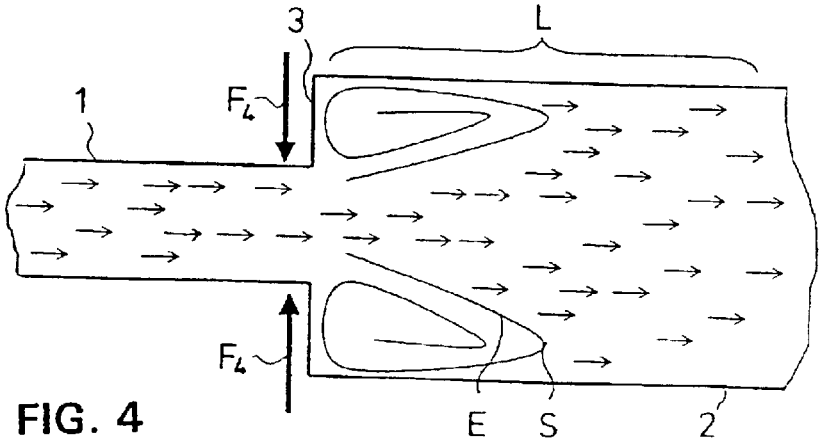
FIG. 4 shows an alternative chemicals dosing position immediately before a pipe expansion.

In order that the chemical being fed should be mixed with the fibre suspension uniformly, it shall be added to the flow in a stage in which the flow is highly fluidized. In that connection, the degree of flocculation of the fibre suspension is low and turbulence is sufficiently strong to ensure that the chemicals are mixed but not so violent that it would break up the polymer chains of the chemicals. FIGS. 2–4 show different positions in connection with a pipe expansion, to which positions a chemicals addition can be fed to achieve uniform and efficient mixing.

FIG. 2 shows one arrangement in accordance with the invention for feeding chemicals into a fibre suspension. A chemicals flow $F_1$ is introduced into an expansion step 3 in a direction parallel to the main flow close to the location where the main flow discharges from a first pipe 1 into a second pipe 2. The chemicals flow $F_1$ fed into the expansion point of the pipe is directed at a reverse vortex E such that it is guided to the boundary surface between the reverse vortex and the main flow. The turbulence generated by the reverse vortex E breaks up flocs present in the fibre suspension and, at the same time, the turbulence causes the chemicals to be uniformly mixed into the fibre suspension flow. In practice, the feeding of chemicals is accomplished through injection holes or injection tubes which are disposed symmetrically in the expansion step 3 and which are not shown in detail in the figure.

FIG. 3 shows two alternative chemicals dosing positions, in the first of which a chemicals flow $F_2$ is directed obliquely at the middle of a reverse vortex E and in the second of which a chemicals flow $F_3$ is directed at such a point in the flow after a stagnation point S in which the fibre suspension is still very well mixed.

In FIG. 4, a chemicals flow $F_4$ is fed into a fibre suspension flow in a first pipe 1 immediately before an expansion step 3. The dosing position shall be so close to the expansion point that the chemicals being fed have no time to react or to be attached to fibres before the flow is efficiently mixed in the pipe expansion.

Figure 5:
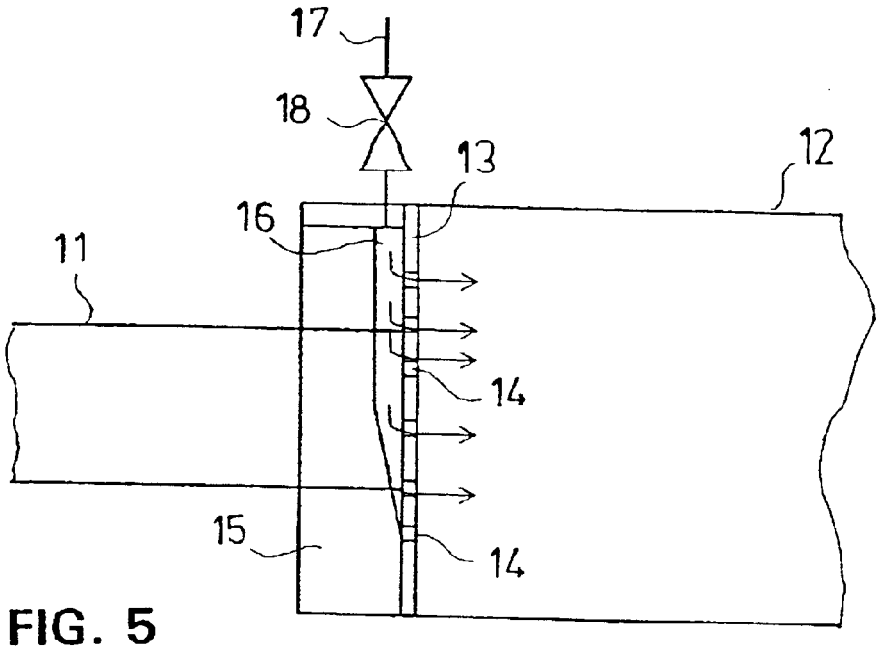
FIG. 5 shows the feeding of chemicals through a feed flange attached to an expansion step.
Figure 6:
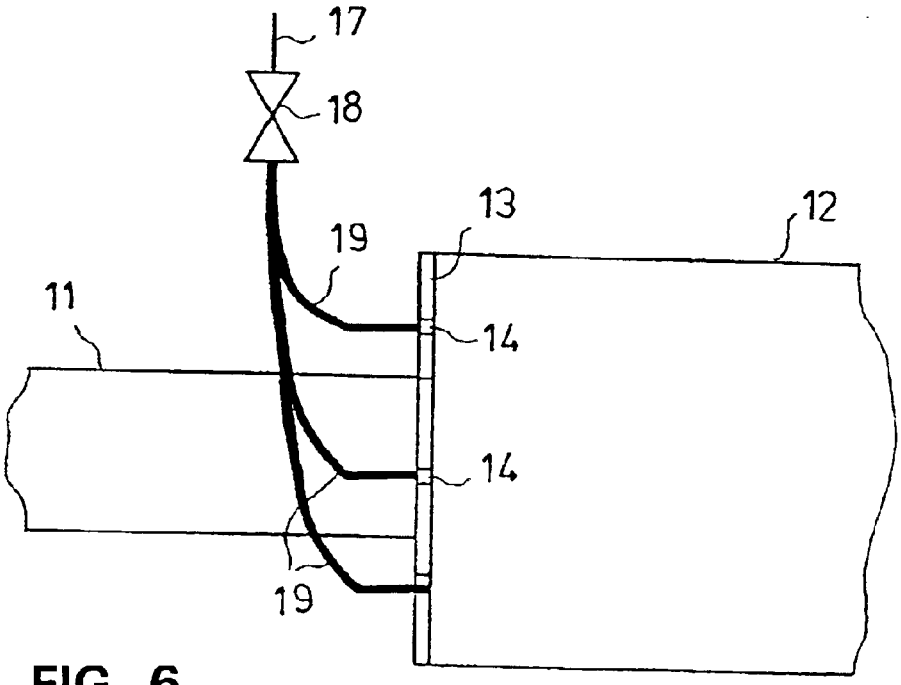
FIG. 6 shows the feeding of chemicals through feed hoses connected to an expansion step.

FIGS. 5 and 6 show two alternative embodiments of the invention, in which the feeding of chemicals is arranged in connection with an accept flange 13 of a machine screen preceding a headbox, a flow throttle tube 11 being fitted directly to the screen (not shown). The accept flange 13 is provided with a plurality of injection holes 14, through which a chemicals flow is fed in a direction parallel to the main flow discharging from the throttle pipe 11 so as to be mixed with the fibre suspension flow. The injection holes 14 surround symmetrically the inlet opening of the pipe 11. The axes of the pipes 11 and 12 coincide, so that the flow duct expands at a step 3 in a rotationally symmetrical manner.

In FIG. 6, a chemicals addition is introduced through hoses 19 directly into the injection holes 14 situated in the accept flange 13.

In the example of FIG. 5, the accept flange 13 incorporates a chemicals feed flange 15, which includes one or more feed grooves 16 from which the chemicals discharge through the injection holes 14 into the pipe 12. The chemicals feed grooves 16 can be accomplished as the same type of arrangement as the grooves used for feeding dilution water in dilution headboxes. The chemicals flow is passed into the grooves 16 of the feed flange 15 through a pipeline 17 provided with a valve 18.

The principle of feeding chemicals in accordance with the invention, which makes use of the maximal shear field created in the flow by a rotationally symmetric pipe expansion, can be applied in different stages of the papermaking process. The method operates in the described manner when dosing both large and small quantities of chemicals, and it is suitable for dosing all chemicals and additives added to the paper stock in the short circulation. The state of the chemicals which are added may be gaseous, liquid or solid or it can be a mixture of these.

We claim:

1. A method for feeding chemicals into a fibre suspension in the short circulation of a paper machine, between a machine screen and a headbox comprising the steps of:

passing a fiber suspension flow through a pipe expansion comprising a first pipe having a first diameter which is connected at an expansion step to a second pipe of a second diameter which is larger than the first diameter, and wherein the first pipe and the second pipe are coaxial, the expansion step extending perpendicular to the direction of the fiber suspension flow;

wherein the expansion step has a height defined as one-half the second diameter minus the first diameter;

feeding a chemicals flow into the fiber suspension flow at a location, the location being positioned from immediately before the pipe expansion, wherein the chemicals flow is so close to the expansion step that the chemicals have no time to react with the fibre suspension before the flow enters the expansion step, to downstream of the expansion step a length up to 50 times the height; and following feeding the chemicals flow, feeding the fiber suspension flow into the headbox.

2. The method of claim 1 wherein the chemicals flow is passed so as to be mixed with the fibre suspension flow in the second pipe in an ideal mixing zone situated after the expansion step, the axial length of which zone is 20–50 times the height of the expansion step.

3. The method of claim 1 wherein the chemicals flow is polymer chains, which act as retention aids.

4. A device for feeding chemicals into a fibre suspension in the short circulation of a paper machine, between a machine screen and a headbox, the device comprising:

a rotationally symmetrical pipe expansion comprising a first pipe connected to the machine screen having a first diameter, and a second pipe having a diameter greater than the first diameter, and wherein the first pipe and the second pipe are coaxial, the second pipe being connected to the first pipe at an expansion step which extends perpendicular to a direction of flow through the connected pipes;

wherein the expansion step has a height defined as one-half the greater diameter minus the first diameter;

a plurality of injection holes in the pipe expansion opening into the pipe expansion at, or downstream from, the expansion step a length of up to 50 times the height, to allow the passing of a chemicals flow into a fibre suspension flow flowing through the pipe expansion; and a headbox connected to the second pipe.

5. The device of claim 4 wherein the plurality of injection holes are arranged on the circumference of the second pipe at a distance from the expansion step which is 20–50 times the height.

6. The device of claim 4 wherein the first pipe is an accept pipe of the machine screen preceding the headbox, and the machine screen has an accept flange which defines the expansion step.

7. The device of claim 6 wherein the injection holes are defined in the accept flange, and wherein a chemicals feed flange is connected to the accept flange of the machine screen, which feed flange includes flow ducts for passing the chemicals flow into the injection holes.

8. The device of claim 4 wherein the ratio of the diameter of the second pipe to the diameter of the first pipe is in a range of $D_2/D_1$=1.1–5.0.

9. The device of claim 4 wherein the expansion step is at least 2 mm.

10. The device of claim 9 wherein the height of the expansion step is at least 50 mm.

11. The device of claim 4 wherein the plurality of injection holes is connected to a source of polymer chains, which act as retention aids.

12. The device of claim 4 wherein the means for passing a chemicals flow into a fibre suspension flow is connected to a source of polymer chains, which act as retention aids.

13. A device for feeding chemicals into a fibre suspension in the short circulation of a paper machine, the device comprising:

a machine screen having an accept pipe forming a first pipe of a first diameter;

a rotationally symmetrical pipe expansion comprising the first pipe and a second pipe of a second diameter having a larger diameter than the first pipe, and wherein the first pipe and the second pipe are coaxial, which pipes are connected to each other by means of an expansion step perpendicular to the direction of flow;

wherein the expansion step has a height defined as one-half the second diameter minus the first diameter;

means for passing a chemicals flow into a fibre suspension flow flowing through the pipe expansion in connection with said pipe expansion at a location, the location being positioned from immediately before the expansion step up to a length of 50 times the height downstream from the expansion step; and a headbox connected to the second pipe.

14. The device of claim 13 wherein the means for passing the chemicals flow into the fibre suspension flow comprises a plurality of injection holes and means for passing the chemicals flow into said injection holes.

15. The device of claim 14 wherein the means for passing the chemicals flow into the fibre suspension flow comprises a plurality of injection holes arranged in a flange serving as the expansion step.

16. The device of claim 14 wherein the means for passing the chemicals flow into the fibre suspension flow comprises a plurality of injection holes arranged on the circumference of the second pipe at a location the distance of which from the expansion step is 20–50 times the height of the expansion step.

17. The device of claim 14 wherein the means for passing the chemicals flow into the fibre suspension flow comprises a plurality of injection holes arranged on the circumference of the first pipe at a location which precedes the expansion step.

18. The device of claim 13 wherein the machine screen has an accept flange which serves as the expansion step.

19. The device of claim 18, wherein a chemicals feed flange is connected to the accept flange of the machine screen, which feed flange includes flow ducts for passing the chemicals flow into injection holes provided in the accept flange.

20. The device of claim 13 wherein the ratio of the diameter of the second pipe to the diameter of the first pipe is in a range of $D_2/D_1$=1.1–5.0.

21. The device of claim 13 wherein the height of the expansion step is at least 2 mm.

22. The device of claim 21 wherein the height of the expansion step is at least 50 mm.

* * * * *

UNITED STATES PATENT AND TRADEMARK OFFICE

CERTIFICATE OF CORRECTION

PATENT NO. : 6,841,040 B2
DATED : January 11, 2005
INVENTOR(S) : Hannu Lepomäki et al.

It is certified that error appears in the above-identified patent and that said Letters Patent is hereby corrected as shown below:

Column 3,
Lines 42, 44 and 47, “floes” should be -- flocs --

Column 6,
Line 54, delete the comma after the numeral “18”

Signed and Sealed this

Third Day of May, 2005

JON W. DUDAS
*Director of the United States Patent and Trademark Office*